United States Patent [19]

Fischer

[11] 4,137,788

[45] Feb. 6, 1979

[54] APPLICATION FOR USE WITH A STRAPPING MACHINE FOR DISPLACING AND TENSIONING A STRAPPING BAND ABOUT AN ARTICLE OR THE LIKE

[75] Inventor: Karl Fischer, Wohlen, Switzerland

[73] Assignee: Strapex AG, Hergiswil, Switzerland

[21] Appl. No.: 834,449

[22] Filed: Sep. 19, 1977

[30] Foreign Application Priority Data

Oct. 8, 1976 [CH] Switzerland ..... 12792/76

[51] Int. Cl.[2] ..... F16H 7/08; B65B 11/00

[52] U.S. Cl. ..... 74/242.9; 53/203

[58] Field of Search ..... 74/242.9; 53/203

[56] References Cited

U.S. PATENT DOCUMENTS

| | | | |
|---|---|---|---|
| 3,323,275 | 6/1967 | Kingsbury et al. | 53/203 X |
| 3,367,589 | 2/1968 | Chant, Jr. et al. | 53/203 X |

*Primary Examiner*—Leonard H. Gerin
*Attorney, Agent, or Firm*—Werner W. Kleeman

[57] ABSTRACT

An apparatus for use with a strapping machine for displacing and tensioning a strapping band about an article or the like, wherein band rolls, about which there is wrapped the strapping band, are operatively coupled with a reversible drive motor, and between the drive motor and at least one of the band rolls there is provided a speed reduction stage which is switched-on, due to the response of an overload coupling, during the rotational sense corresponding to tensioning of the strapping band. According to the invention, three successive band rolls are provided which are coupled with one another for carrying out the same peripheral rotation by means of a form-locking transmission or drive. During the rotational sense or direction, corresponding to the feed direction, the transmission or drive elements associated with the first and the third band rolls form a step-up transmission for the transmission or drive element of the intermediate band roll, whereas with a rotational sense corresponding to tensioning of the band the transmission element of the intermediate band roll is capable of being coupled direct with the drive motor by means of a freewheeling coupling, which blocks in response to the overload coupling, through the agency of the speed reduction stage.

11 Claims, 3 Drawing Figures

Fig. 2
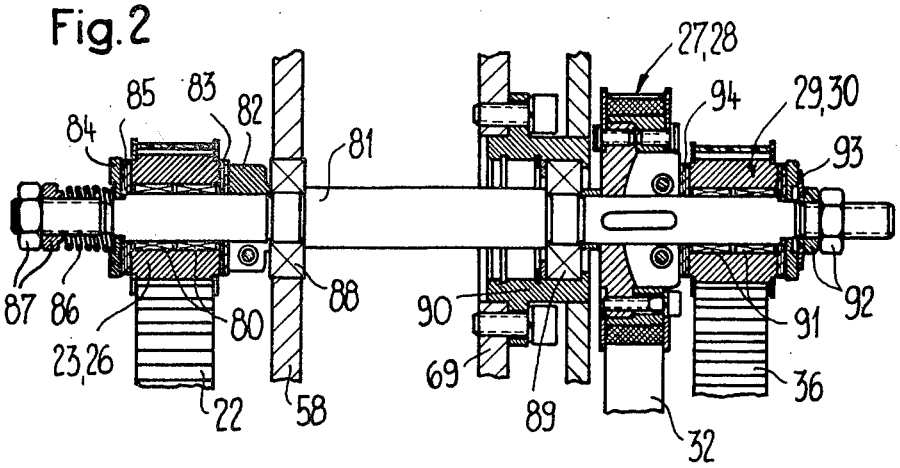
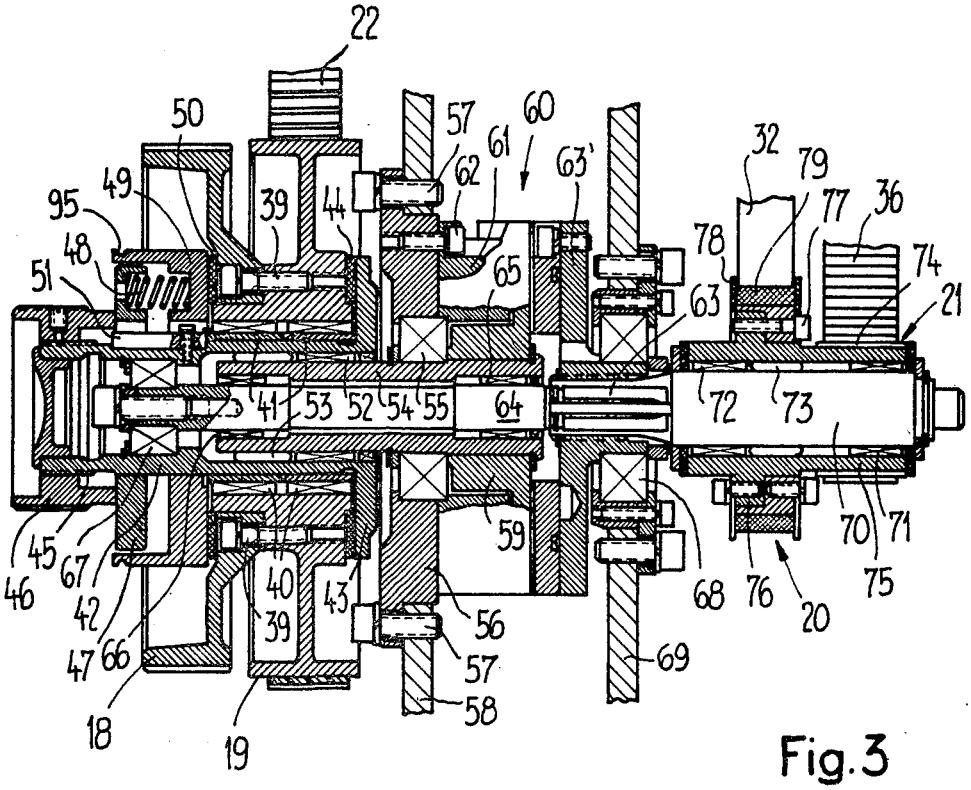
Fig. 3

APPLICATION FOR USE WITH A STRAPPING MACHINE FOR DISPLACING AND TENSIONING A STRAPPING BAND ABOUT AN ARTICLE OR THE LIKE

BACKGROUND OF THE INVENTION

The present invention relates to a new and improved construction of apparatus for use at a strapping machine for displacing and tensioning a strapping band about an article or the like, comprising band rolls operatively coupled with a reversible drive motor, the strapping band being wrapped around the band rolls, and between the drive motor and at least at one of the band rolls there is provided a speed reduction stage which, with a rotational direction or sense corresponding to tensioning of the strapping band, can be switched-on due to response of an overload coupling.

With a heretofore known apparatus of this type, for instance as disclosed in German Pat. No. 1,611,979, there are provided two band rolls about which there is wrapped the strapping band in a substantially S-shaped loop. These band rolls forwardly displace the band during a more rapid forward travel, after reversal of the drive means into an initially likewise more rapid return movement, place the strapping band about the article, and following completion of placement of the strapping or wrapping band about the article, i.e. when the overload coupling responds, then there is effective the speed reduction stage which imparts an increased rotational moment or torque to one band roll at lower rotational speed, with the result that the strapping band now is properly tensioned about the article or the like.

Normally, with a strapping machine of this type, one machine cycle is completed at the end of the forward movement of the strapping band and a further machine cycle begins during the reverse or rearward movement, i.e., with the tensioning of the band which has been forwardly shifted during the proceeding machine cycle. If, however, during the following description the forward travel is mentioned and described before the return travel of the band, then this is so because it is to be assumed that such is more easily compatible with the understanding of the reader of the disclosure.

It has been found with the state-of-the-art apparatus that it requires additional means in order, on account of the reversible drive, to retain the strapping band at least during the forward movement or travel in contact with the band rolls. Further, in the second phase of the return movement or travel only the one band roll is driven at a higher or increased rotational movement, whereas the other band roll, just as was previously the case, is driven at the lower rotational moment, so that such practically does not contribute at all to tensioning of the band.

SUMMARY OF THE INVENTION

Hence, with the foregoing in mind it is a primary object of the present invention to provide an improved construction of apparatus for use at a strapping machine for displacing and tensioning a strapping band about an article or the like, in a manner not associated with the aforementioned drawbacks and limitations of the prior art proposals.

Another and more specific object of the present invention is directed to the provision of a new and improved construction of apparatus for a strapping machine for displacing and tensioning a strapping band about an article, which apparatus is relatively simple in construction and design, economical to manufacture, extremely easy to use, not readily subject to breakdown or malfunction, and provides for positive, reliable and efficient strapping of the article with the strapping band.

Now in order to implement these and still further objects of the invention, which will become more readily apparent as the description proceeds, the invention contemplates that there are provided three successive band rolls which are operatively coupled with one another by means of a form-locking transmission or drive for rotation with the same peripheral speed. During the rotational direction corresponding to the feed direction, the transmission or drive elements correlated with the first and the third band roll form a step-up transmission for the transmission or drive of the intermediate band roll, whereas during the rotational direction, corresponding to tensioning of the strapping band, the transmission or drive element of the intermediate band roll can be coupled directly with the drive motor or drive means through the agency of a freewheeling coupling which blocks upon response of the overload coupling and by means of the speed reduction stage.

The transmission elements of the first and the third band rolls can be coupled by means of a respective slip coupling at a step-up stage coupled with a slower running element of the speed reduction stage, the aforementioned slip couplings forming the overloading coupling. The slower running element of the speed reduction stage and the freewheeling coupling which blocks upon response of the overload coupling, are advantageously arranged coaxially with regard to the intermediate band roll.

It is especially of advantage if the form-locking transmission or drive which mutually couples the three band rolls for rotation with the same peripheral speed, is formed by a toothed belt drive. Also, the speed reduction stage is advantageously constituted by a further toothed belt drive. Finally, also the step-up stage can be formed by a toothed belt drive, so that all of the drive connections are formed by practically noiseless running, but form-locking belt drives. This preferred construction of all drive connections or transmission stages as form-locking toothed belt drives provides, in contrast to the comparable heretofore known devices which operate with gear drives, an appreciably quieter running, and therefore, aleviate both for the designer as well as personnel responsible for maintenance all problems which deal with lubrication (oil baths, seals).

BRIEF DESCRIPTION OF THE DRAWINGS

The invention will be better understood and objects other than those set forth above, will become apparent when consideration is given to the following detailed description wherein:

FIG. 2 is a sectional view along the lines II—II of the arrangement of FIG. 1; and FIG. 3 is a sectional view along the line III—III of FIG. 1, wherein FIG. 3 is aligned in the manner of FIG. 2 in such a way that rolls and belt pulleys which coact by means of the strapping band and by the belts, respectively, appear directly above one another.

DETAILED DESCRIPTION OF THE PREFERRED EMBODIMENTS

Figure 1:
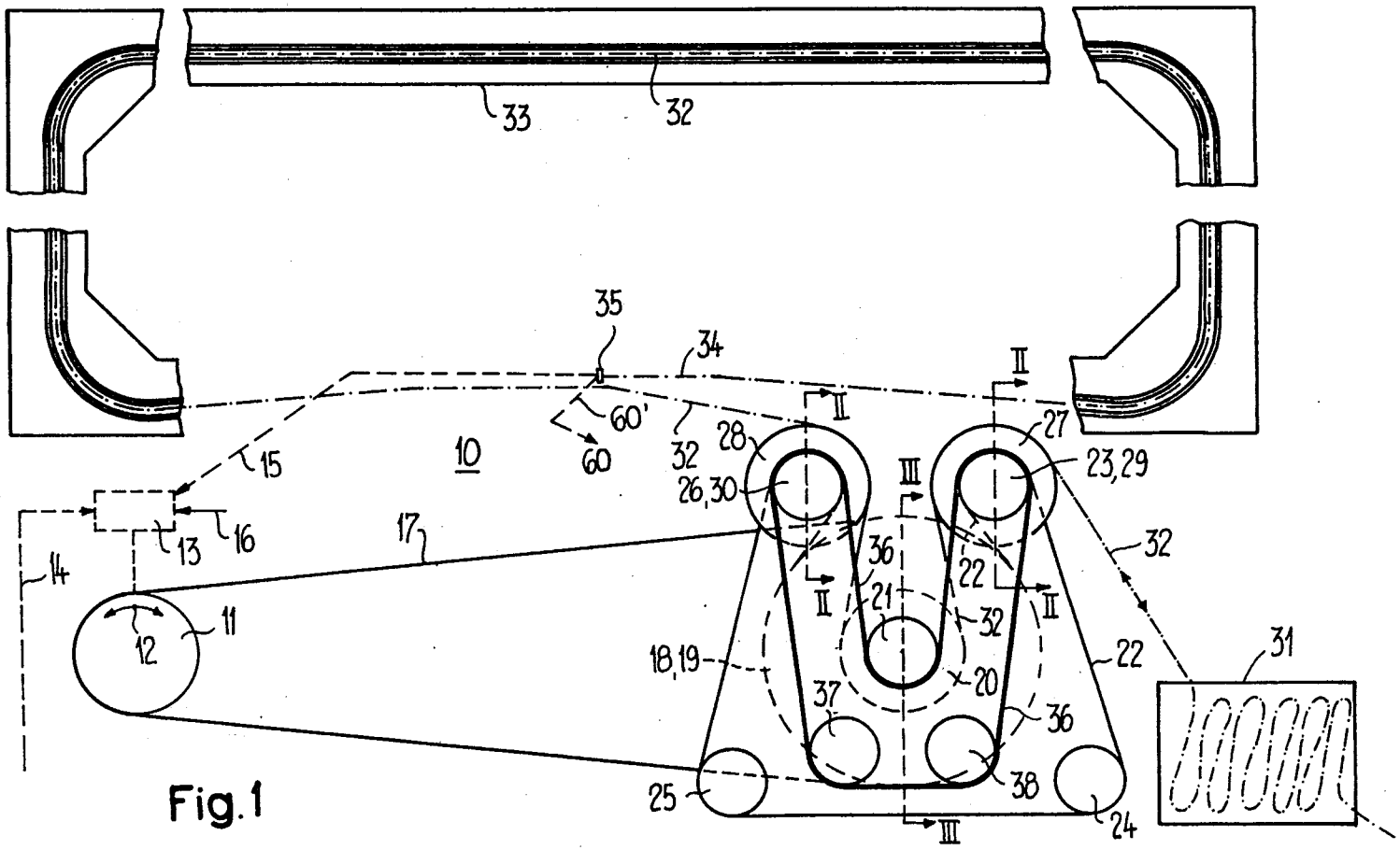
FIG. 1 is an extremely schematic front view of the apparatus in order to explain the course of travel of the strapping band about the band rolls as well as the course of the different belt drives or transmissions.

Describing now the drawings, the apparatus 10 shown in FIG. 1 will be seen to comprise a schematically illustrated drive motor 11 which, as indicated by the double-headed arrow 12, can be reversed as concerns its direction of rotation. For this purpose, there is provided a pole changeover and switch-on protective device 13, which, for instance, is controlled by three control lines or conductors 14, 15 and 16. The line or conductor 14 leads from the protective device 13 to a foot-or hand switch of conventional design and therefore not particularly shown, during the actuation of which the device is caused to carry out one work cycle. As to the control lines 15 and 16 such will be considered more fully hereinafter.

The drive motor 11 drives a belt pulley 18 by means of a toothed belt 17. A further belt pulley 19, which in this case possesses approximately the same diameter as the belt pulley 18, is fixedly connected therewith. Coaxially arranged with regard to the belt pulleys 18 and 19 is an intermediate band roll 20 and a toothed belt pulley 21 associated therewith. The belt pulley 19 is almost completely wrapped by the flat side of a toothed belt 22, which engages at its toothed side with a toothed disk 23, with two freely rotatable deflection rolls 24 and 25 having teeth and with a further toothed disk 26. Coaxially arranged with respect to the toothed disks 23, 26 are a first band roll 27 and a third band roll 28, respectively, as well as two further toothed disks 29, 30 which are associated therewith, these toothed disks 29, 30 having practically the same diameter as the toothed disks 23, 26 and thus appear in FIG. 1 each in the form of a single circle.

A strapping band 32 (shown in phantom or chain-dot lines) which is withdrawn from a supply magazine 31 initially wraps about the first band roll 27, then the intermediate band roll 20 and the third band roll 28 in order to thereafter (until the end of the feed phase) travel in a band guide 33 which has been schematically shown and which is in the form of a practically closed gantry and serves for the reception of the article or the like which is to be strapped. The leading end 34 of the strapping band 32 impinges against a schematically depicted terminal or end switch 35, actuates such, which in turn causes that by means of the control line 15 the protective device 13 reverses the direction of rotation of the drive motor. What still is to be explained is that during the feed phase, the drive motor 11 of the showing of FIG. 1 rotates in the clockwise direction and during the tensioning phase in counter-clockwise direction.

The toothed disks 29, 30 which are operatively associated with the band rolls 27 and 28, are coupled by means of a belt 36 which is provided with teeth at both sides, the belt being shown in thicker lines, with the toothed belt pulley 21, which, in turn, is operatively associated with the band roll 20. Since the band rolls 20, 27, 28 mutually possess the same diameter and this is also true of the disks 21, 29 and 30 which likewise mutually possess the same diameter, it will be apparent that the band rolls 20, 27, and 28 automatically always possess the same peripheral speed. The belt 36 which is provided with teeth at both sides or faces, and best seen by referring to FIG. 1, is also guided about two tensioning rolls or rollers 37 and 38.

From what has been discussed above it will also be apparent that as long as the drive means of the band rolls 20, 27 and 28 is accomplished by means of the toothed belt 22, the rotational speed of which is comparatively high, because the belt pulley 19 driven by the tooth belt 22 possesses a larger diameter than the toothed disks 23 and 26, resulting in a step-up stage. As soon as, however, the drive is accomplished from the belt pulley 18 directly to the toothed belt pulley 21 which is associated with the intermediate band roll 20 and from that location by means of the toothed disks 29 and 30 to the first and third band rolls 27 and 28, respectively, their rotational speed becomes appreciably smaller. How such different drive connections arise with the exemplary embodiment under discussion, will be explained more fully hereinafter in conjunction with FIGS. 2 and 3.

In FIG. 3 there will be recognized the toothed belt pulley 18 which is coupled with the motor 11 by means of the not here illustrated toothed belt 17. Equally, there will be recognized the belt pulley 19 which is wrapped around by the flat side of the toothed belt 22. The belt pulleys 18 and 19 are blocked as a unit by means of a bolt 39, this unit in turn being rotatably mounted by means of two roller bearings 40 while interposing spacer rings 41 upon a bushing or sleeve 42. Formed at one end of the bushing 42 is a flange 43 which carries a friction coating or covering 44 which snugly bears against the end face of the hub of the pulley 19. At its other end the bushing 42 is provided with external threading 45, on to which there is threaded an adjustment nut 46 which in turn acts upon a disk 47. At the side of the disk 47 which faces away from the adjustment nut 46 there are supported a number of pressure or compression springs 48 which act upon a cup-shaped counter-element 49 which, in turn, is equipped with a friction lining or coating 50 which is snugly pressed against the flat side of the belt pulley 18. The disk 47 as well as its counter-element 49 are mounted to be axially displaceable upon the bushing 42, however are secured against a relative rotation by means of a wedge or key 51 or equivalent structure. The components or parts 42 to and including 50 thus form an adjustable overload-or slip coupling, by means of which the belt pulleys 18 and 19 are force-lockingly coupled with the bushing 42, and the response rotational movement of such coupling can be adjusted by means of the adjustment nut 46 or equivalent structure.

The bushing 42 is mounted by means of a roller bearing 52 and a freewheeling coupling 43 upon the outside of a hollow shaft 54. The freewheeling coupling 53 blocks in the tensioning direction, i.e. it blocks when the bushing 42 has the tendency of rotating relative to the hollow shaft 54 in the tensioning direction (in the counter-clockwise direction of FIG. 1). Therefore, only in this rotational direction is the bushing 42 rigidly connected or coupled for rotation with the hollow shaft 54. The hollow shaft 54, in turn, is mounted by means of a further freewheeling coupling 55 in a bearing flange 56 which is attached by means of bolt 57 or equivalent structure to a wall 58 of the machine frame.

The freewheeling coupling 55 blocks in the feed direction, i.e. prevents the hollow shaft 54 from carrying out a rotation in the feed direction (in the clockwise direction of FIG. 1). Seated upon the end of the hollow shaft 54 which is directed away from the freewheeling coupling 53 is one-half 59 of an electromagnetic coupling 60, the excitation portion or part 61 which is secured by means of bolt 62 or the like to the bearing flange 56. The second half 63' of this electromagnetic coupling 60 is seated, in turn, rigidly for rotation upon a grooved section 63 of a lengthwise extending shaft 64 which, in turn, is rotatably mounted by means of the roller bearings 65, 66 and 67 in the hollow shaft 54 and in the bushing 42, as well as is rotatably mounted by means of a further roller bearing 68 via the hub of the coupling half 63' is a further wall 69 of the machine frame. The comparatively long length of the shaft 64 and its multiple-support arrangement in different parts which in turn can be rotated, ensures for a faultless coaxial positioning of these parts, and, additionally, a stability of the end 70 of the shaft 64 which protrudes past the wall 69.

Upon the end 70 of the shaft 64 there is mounted by means of the roller bearings 71 and 72 and by means of a further freewheeling coupling 73 both the intermediate band roll 20 as well as also the toothed belt pulley 21 which is associated therewith. The freewheeling coupling 73 blocks in the feed direction, i.e. couples the band roll 20 together with the belt pulley 21 fixedly with the shaft 64, when the band roll 20 is driven in the feed direction. The belt pulley 21 is constructed as a toothed section 74 at the outer periphery of a hub-like hollow body 75 which surrounds the end 70 of the shaft 64. The band roll 20 is fixedly threaded by means of a bolt 77 to a radially protruding flange 76 of this hollow body 75, and such band roll 20, in turn, possesses peripheral lining 79 clamped at its ends between two guide rims 78 and frictionally coacting with the strapping band 32. In FIG. 3 there will also be recognized the belt 36 which is provided with teeth at both faces or sides, which leads to the toothed pulleys or disks 29 and 30, respectively, which are operatively associated with the first and third band rolls 27 and 28 respectively.

It was already mentioned that FIG. 2 is a sectional view along the lines II—II of FIG. 1, i.e., that both of these sections are practically identical. From this it follows that for certain components shown in FIG. 2 there are used two reference characters whereas, on the other hand, practically all components designated in FIG. 2 with one reference character are in reality present twice.

From the showing of FIG. 2 there will be recognized the toothed belt 22, which, starting from the belt pulley 19, wraps about both of the toothed pulleys 23 and 26. These pulleys 23 and 26 are each mounted by means of roller bearings 80 upon one end of a shaft 81 and are frictionally clamped between a coupling element or piece 82 having a friction lining 83 and fixedly seated upon such shaft 81 and a spring-prebiased counter element 84 likewise equipped with a friction lining or coating 85. The pre-bias of the counter element 84 is accomplished by a compression or pressure spring 86, the pressure force of which can be adjusted by means of the nuts 87 threaded onto the free end of the shaft 81. The components 82 to 87 thus form a slip-or overload coupling, by means of which each of both toothed pulleys or disks 23 and 26 is coupled with the associated shaft 81.

The shafts 81 which are rotatably mounted by means of a roller bearing 88 in the wall 58 and by means of a further roller bearing 89 in a bearing support 90 attached to the wall 69, carry at their outer ends the first and third band rolls 27 and 28, respectively, which are keyed thereto or otherwise appropriately connected therewith, these band rolls 27 and 28 being similar in their construction to the intermediate band roll 20. A difference resides however in the fact that they are not absolutely rigidly connected with the toothed pulleys or disks 29 and 30, respectively, which are operatively associated therewith. These pulleys 29 and 30 are rotatably mounted by the roller bearings 91 upon the shaft 81 and at the same time by means of a plate spring 93 supported upon the nuts 92 while interposing a friction lining 83 and pressed axially against the band rolls 27 and 28 respectively. It is to be observed that the friction connection between the toothed pulleys 29 and 30 and the related band rolls 27, 28, respectively, in any event is considerably greater than the frictional connection or friction brought about by the overload-or slip coupling 82 to 87. The illustrated coupling of the toothed pulleys 29 and 30 with the associated band rolls 27 and 28 is to be understood as being a purely safety measure. Functionally it would be possible for the band rolls 27 and 28 to be fixedly coupled with the associated pulleys 29 and 30 and to be seated therewith upon the corresponding shaft 81.

The mode of operation of the illustrated apparatus will be described in the sequence of forwardly feeding-tensioning the strapping band 32, since such will be easier to understand, although, as already mentioned, in practice a machine cycle normally begins with the tensioning operation, since at the end of the preceding machine cycle the forward feeding of the strapping band 32 has already been accomplished in the guide or guide means 33.

In order to forwardly feed the strapping band 32 the drive motor 11 is turned-on for rotation in the clockwise direction (FIG. 1). Consequently, the belt pulley 18 and together therewith the belt pulley 19 are driven and thus also the bushing 42 which is frictionally connected with both such pulleys. Since the freewheeling coupling 53 does not block during this rotational direction, there does not occur any transmission of the drive force to the hollow shaft 54. Quite to the contrary, the drive force is transmitted from the toothed belt 22 to the toothed pulleys or disks 23 and 26, and such drive connection is comparable to a speed step-up stage. The drive is thus transmitted by means of the overload-or slip coupling 82 to 87 to both shafts 81, and from such to the first and to the third band rolls 27 and 28, respectively, and to the related toothed pulleys 29 and 30. From here there is accomplished by means of the toothed belt 36 the drive of the belt pulley 21 with the intermediate band roll 20 at the same, comparatively high rotational speed. During this direction of rotation the freewheeling coupling 73 blocks, so that the shaft 64 and the coupling half 63' entrainably rotates the coupling 60 which is vented during this phase. This operation is continued until response of the terminal switch 35.

As soon as the terminal or end switch 35 is actuated, then it switches by means of the protective device 13 the direction of rotation of the drive motor 11 and thus brings about by means of the control line 60' that the coupling 60 will be energized, i.e., that both halves 59 and 63' will be force-lockingly coupled with one another. Now there occur the drive connections initially as previously described, wherein, however, additionally due to the blocking of the freewheeling coupling 53 the hollow shaft 54 is rotated and equally due to the energized coupling 60 there is also co-rotated the solid shaft 64, but at a lower rotational speed than the band rolls 27, 28 and 20 which, in turn, are driven at a still higher rotational speed by means of the belt 22, the toothed pulleys 23 and 26 and the overload coupling 82 to 87. The freewheeling coupling 73 does not block, because there is present a relative rotation in the tensioning direction between the shaft 64 (rotating at a slower speed) and the components 20 and 21 (rotating at a more rapid speed). As soon as the strapping band 32 bears at the article or the like which is to be strapped, then the band rolls 27, 28 and 20 are braked by the strapping band 32 which cannot be further drawn-through. This causes the overload coupling 82 to 87 to respond. Since the braking of the intermediate band roll 20 now is transmitted also to the hollow shaft 54 by means of the now attracted or energized coupling 60, the freewheeling coupling 53 simultaneously blocks. Consequently, the drive is now accomplished at a lower rotational speed, i.e. at a higher rotational moment by means of the freewheeling coupling 53 to the hollow shaft 54, via the attracted coupling 60 (the freewheeling coupling 55 allows such rotational direction) to the shaft 64 and from that location by means of the now blocking freewheeling coupling 73 to the band roll 20, the toothed belt pulley 21 and thus by means of the belt 36 also to the first and third band rolls 27 and 28 respectively. The band rolls therefore have transmitted thereto a higher rotational moment than previously, so that the strapping band 22 is tensioned.

The drive connection to the hollow shaft 54 and to the shaft 64 remains however only for such length of time as the frictional connection between the pulleys 18 and 19 on the one hand and the bushing 42 on the other hand has not been overcome. This frictional connection — which can be adjusted by means of the adjustment or setting nut 46 — is thus decisive for the desired band tension. As soon as such has been reached, it is sufficient in order to completely brake the band rolls, so that all components come to rest with the exception of the belt pulleys 18 and 19. This standstill condition is detected by not particularly illustrated means, for instance at a groove 95 at the periphery of the counter-element 49 (FIG. 3), which in turn switches-off the drive motor 11, for instance by means of the control line 16, and activates a likewise not particularly illustrated welding device for heat sealing or welding the overlapping ends of the strapping band 32. During this time there is impossible any reverse rotation of the band rolls 20, 27 and 28, since the band rolls are prevented from any such reverse rotation by the freewheeling coupling 55, in other words, a rotation in the feed direction, since at this moment the coupling 60 is still energized. Only after completion of the heat sealing operation which is performed at the overlapping band ends is the coupling 60 vented and the motor turned-on for a further feed cycle, for instance by means of a control line similar to control line 16.

Particular advantages of the described apparatus reside in the fact that the band rolls, in the one and in the other rotational direction, are always driven at the same peripheral speed and thus both during the feed as well as during tensioning of the strapping band deliver an equal contribution, because between the strapping band and the band rolls there practically does not occur any slip, and finally, with the exception of the roller bearings, the entire apparatus can function practically without lubrication, something not possible with the heretofore employed gear transmissions or drives. Additionally the exclusive use of the belt drives allows for a comparatively simple construction, so that the moment of inertia or gyration of the apparatus remains low, something of particular significance when changing the direction of rotation of the motor. Furthermore, the described apparatus works practically free of noise.

While there are shown and described present preferred embodiments of the invention, it is to be distinctly understood that the invention is not limited thereto, but may be otherwise variously embodied and practiced within the scope of the following claims. Accordingly,

What I claim is:

1. An apparatus for a strapping machine for forwardly displacing and tensioning a strapping band about an article or the like, comprising:

a reversible drive motor;

band rolls operatively coupled with said reversible drive motor and about which there is wrapped the strapping band;

means defining a speed reduction stage provided between said drive means and at least one of the band rolls;

an overload coupling;

said speed reduction stage being turned-on due to the response of said overload coupling when there is present a direction of rotation of the band rolls corresponding to tensioning of the strapping band;

said band rolls comprising three successively arranged band rolls defining first, second and third band rolls;

form-locking transmission means for operatively coupling said three band rolls with one another for rotating with the same peripheral speed;

said transmission means including a respective transmission element for each band roll;

said transmission means comprising transmission elements associated with the first band roll and the third band roll during a direction of rotation thereof corresponding to the feed direction of the strapping band;

said transmission elements defining a step-up intermediate transmission for the transmission element of the second band roll defining an intermediate band roll;

a first freewheeling coupling which blocks upon response of the overload coupling;

the transmission element of the intermediate band roll, during a direction of rotation thereof corresponding to tensioning of the strapping band, being directly coupled with said drive motor by said first freewheeling coupling and through the agency of the speed reduction stage.

2. The apparatus as defined in claim 1, further including:

means defining a step-up stage;

a respective slip coupling for coupling the transmission elements of the first band roll and third band roll at the step-up stage which is coupled with a slower travelling element of the speed reduction stage;

said slip couplings constituting said overload coupling.

3. The apparatus as defined in claim 1, wherein:

said slower travelling element of the speed reduction stage and the first freewheeling coupling which blocks upon response of the overload coupling are arranged substantially coaxially with respect to the intermediate band roll.

4. The apparatus as defined in claim 1, wherein:

said form-locking transmission means comprises a first toothed belt transmission.

5. The apparatus as defined in claim 2, wherein:

said speed reduction stage is constituted by a toothed belt transmission which leads away from the drive motor.

6. The apparatus as defined in claim 5, wherein:

said toothed belt transmission includes a slower travelling pulley:

a belt pulley connected with said slower travelling pulley;

said belt pulley comprising a drive element of said step-up stage;

said step-up stage being constituted by a toothed belt transmission.

7. The apparatus as defined in claim 6, wherein:

the slower travelling element of the speed reduction stage and the first freewheeling coupling which blocks upon response of the overload coupling are arranged substantially coaxially with regard to the intermediate band roll;

a bushing upon which there are rotatably mounted said slower travelling pulley and said belt pulley;

a further overload coupling for force-lockingly coupling said slower travelling pulley and said belt pulley with said bushing;

said bushing being operatively coupled by means of the first freewheeling coupling with the transmission element of the intermediate band roll.

8. The apparatus as defined in claim 7, further including:

a shaft member;

said transmission element of the intermediate band roll and said intermediate band roll being rotatably mounted upon said shaft member;

a second freewheeling coupling for coupling said transmission element of the intermediate band roll and said intermediate band roll with said shaft member;

said second freewheeling coupling blocking during rotation of said transmission element of the intermediate band roll and the intermediate band roll in the feed direction of the strapping band and with respect to said shaft member.

9. The apparatus as defined in claim 8, further including:

a shaft;

said bushing being supported by means of the first freewheeling coupling upon said shaft;

coupling means for coupling said shaft with the shaft member carrying the transmission element of the intermediate band roll and such intermediate band roll.

10. The apparatus as defined in claim 9, wherein:

said shaft defines a hollow shaft within which there is rotatably mounted said shaft member.

11. The apparatus as defined in claim 9, further including:

a third freewheeling coupling for securing the shaft against rotation in the feed direction of the strapping band.

* * * * *